United States Patent [19]

Milstein et al.

[11] 4,071,574

[45] Jan. 31, 1978

[54] CONVERSION OF FISCHER-TROPSCH HEAVY PRODUCT TO HIGH QUALITY JET FUEL

[75] Inventors: Donald Milstein; Thomas R. Stein, both of Cherry Hill, N.J.

[73] Assignee: Mobil Oil Corporation, New York, N.Y.

[21] Appl. No.: 671,451

[22] Filed: Mar. 29, 1976

[51] Int. Cl.[2] ..... C07C 1/04; C10G 34/00

[52] U.S. Cl. ..... 260/676 R; 208/79; 208/88; 208/93; 208/120; 208/135; 260/449 R; 260/450

[58] Field of Search ..... 260/676 R, 449 R, 449 M, 260/449.5, 449.6, 450; 208/57, 64, 79, 88, 93

[56] References Cited

U.S. PATENT DOCUMENTS

| | | | |
|---|---|---|---|
| 2,740,804 | 4/1956 | Glazier | 260/450 |
| 2,752,382 | 6/1956 | Garrett et al. | 260/450 |
| 3,172,842 | 3/1965 | Peterson | 208/79 |
| 3,700,585 | 10/1972 | Chen et al. | 208/111 |
| 3,729,409 | 4/1973 | Chen | 208/135 |
| 3,760,024 | 9/1973 | Cattanech | 260/673 |
| 3,843,510 | 10/1974 | Morrison et al. | 208/111 |
| 3,928,483 | 12/1975 | Chang et al. | 260/668 R |
| 3,960,978 | 6/1976 | Givens et al. | 260/683.15 R |

OTHER PUBLICATIONS

Asinger, Paraffins Chemistry & Technology, Pergamon Press, N.Y. (1968) pp. 3, 123-125, 131, 132, 136, 138.

*Primary Examiner*—C. Davis

*Attorney, Agent, or Firm*—Charles A. Huggett; Carl D. Farnsworth

[57] ABSTRACT

Upgrading a Fischer-Tropsch synthesis product by separating a 350° to 850° F product fraction thereof into a 650° F minus fraction and a 650° F plus fraction; separating the 650° F minus fraction to provide a more narrow 350° to 650° F fraction; combining the 650° F plus fraction with a portion of the 350° to 650° F fraction to form a wide boiling range feed material; contacting this formed wide boiling range feed material, together with hydrogen, with a special catalyst comprising a crystalline aluminosilicate zeolite having a silica to alumina ratio of at least 12 and a constraint index of 1 to 12, at a temperature of about 500° to 800° F, a hydrogen partial pressure of about 100 to 800 psia and a space velocity of about 0.5 to 5 LHSV to produce a converted product thereof separating the zeolite conversion product to recover a 350° F minus fraction from a 350° F plus fractions; and separating the 350° F plus fraction to recover a 350° to 450° F jet fuel fraction having a freeze point of less than about −58° F.

9 Claims, 1 Drawing Figure

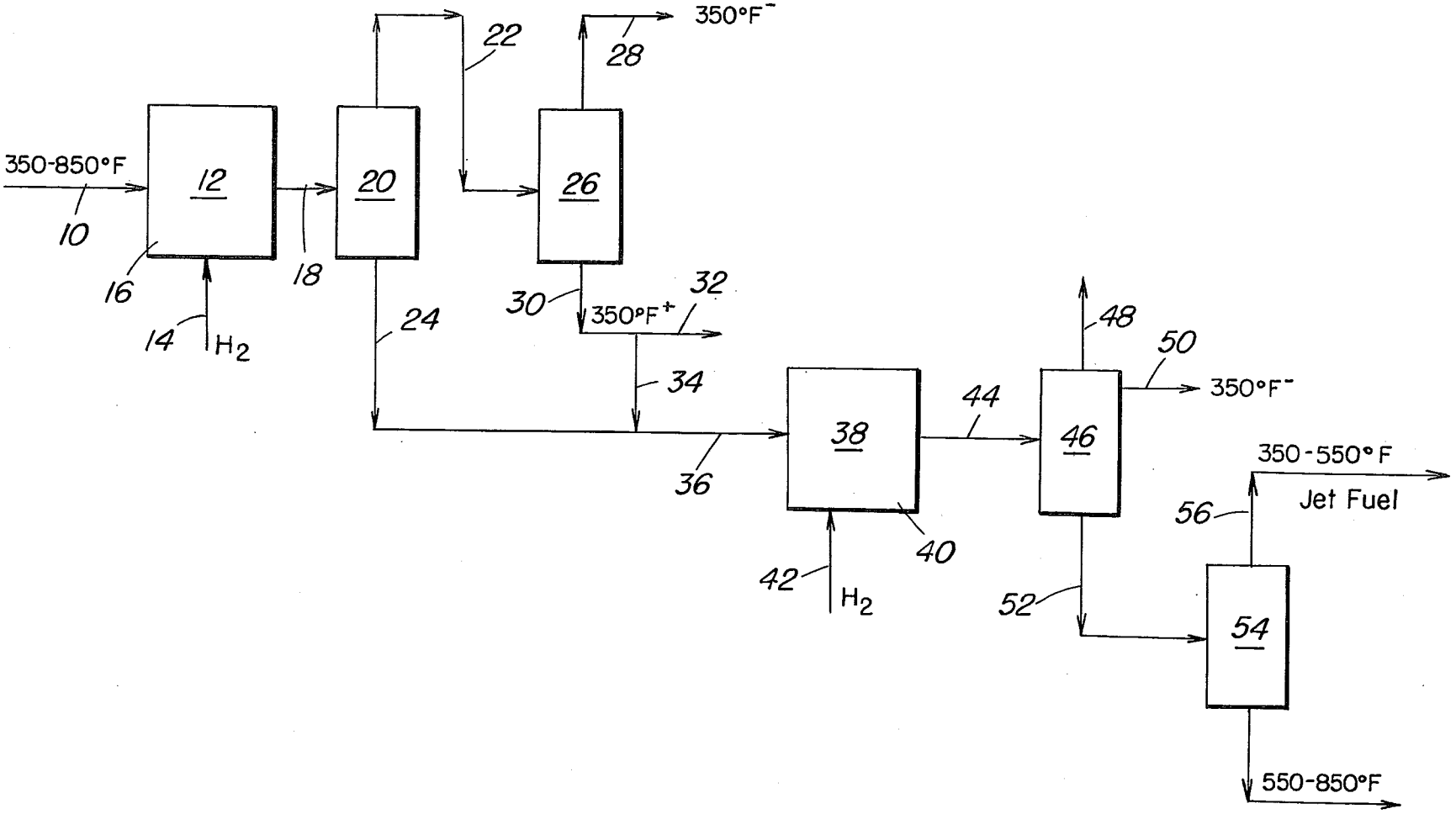
350-850°F
10
16
12
14
$H_2$
18
20
22
24
26
28
350°F⁻
30
350°F⁺
32
34
36
38
42
$H_2$
40
44
46
48
50
350°F⁻
52
54
56
350-550°F
Jet Fuel
550-850°F

CONVERSION OF FISCHER-TROPSCH HEAVY PRODUCT TO HIGH QUALITY JET FUEL

This invention relates to the conversion of certain hydrocarbon streams. It more particularly refers to a rather specific process arrangement for refining a heavy liquid hydrocarbon fraction of Fischer-Tropsch synthesis into a product slate including high quality jet fuel.

It is known that jet fuel must have a rather low freeze point because it must be a pumpable fluid at high altitudes where low temperatures are almost always encountered. A usual technique for providing jet fuel is to simply take a light kerosine (350° to 450° F) cut from crude petroleum and adjust its freeze point and smoke point by conventional techniques including solvent extraction and/or dewaxing. It has been proposed to adjust pour point, cloud point and/or freeze point of distillate fraction, including kerosines by treating them by selective catalytic conversion.

One such catalytic conversion utilizes catalysts comprising ZSM-5 and/or similarly behaving crystalline aluminosilicate zeolites. These catalytic materials have high silica to alumina ratios of greater than 12, constraint indices (as defined in U.S. Pat. No. 3,894,102) of 1 to 12 and preferably a crystal density of not substantially below about 1.6 grams per cubic centimeter. Other zeolites which conform to these parameters are ZSM-11, ZSM-12, ZSM-35, and ZSM-38. This catalytic conversion is suitably operated at a temperature of about 500° to 800° F. In a preferred operation the catalyst has a hydrogenation/dehydrogenation component incorporated therewith, suitably nickel, and the conversion is operated under some hydrogen pressure. This preferred operation lengthens the catalyst cycle life and therefore contributes to the economy of the operation.

In recent times there has been a renewed interest in the production of petroleum products from coal. One such technique utilizes a Fischer-Tropsch process for converting synthesis gas ($CO + H_2$) to a product comprising hydrocarbons and oxygenates including a high boiling range waxy product boiling above 650° F that does not contain the sulfur, nitrogen or metal impurities often found in crude oil. The Fischer-Tropsch hydrocarbon product is roughly separated initially by successive cooling operations, usually by indirect cooling, to first separate out a relatively heavy fraction of hydrocarbons and oxygenates boiling above about 400° F from a gasoline boiling range fraction. The material boiling above 400° F is known as a decant oil. The product boiling below 400° F is further cooled to isolate a $C_5$ to 400° F gasoline boiling range material from lower boiling gaseous materials.

The Fischer-Tropsch product boiling above 400° F is highly aliphatic and in fact is highly olefinic with normal 1-olefins predominating. It is a difficult material to convert to reasonably quality distillate products, particularly to high quality jet fuel.

It is therefore an object of this invention to provide a process for upgrading a Fischer-Tropsch decant oil product comprising oxygenates to produce quality distillate products including high quality jet fuel.

Other and additional objects of this invention will become more apparent from a consideration of this entire specification including the drawing and the claims hereof.

Understanding of this invention will be facilitated by reference to the accompanying drawing, the single FIGURE of which is a block flow diagram of the preferred aspect of the process of this invention.

In accord with and fulfilling these objects, one aspect of this invention resides in upgrading a Fischer-Tropsch decant oil product comprising oxygenates. In the process of this invention the decant oil being upgraded has a boiling range of about 350° to 850° F. Decant oils of other or more narrow ranges may also be upgraded by the process of this invention but the boiling range specified will be used for illustrative purposes as being representative and convenient.

The decant oil is first subjected to a hydropretreatment or hydrogenation operation under conditions sufficiently severe to saturate olefinic compounds and remove oxygenates, particularly organic acids. The hydrotreated product is separated to provide an overhead fraction which roughly boils below about 650° F.

The bottoms product obtained from the separator is roughly 650° plus material. The overhead 650° F minus fraction is then separated to remove naphtha boiling range material having an end point within the range of 350° to about 400° F from a second bottoms fraction comprising higher boiling material. The second bottoms fraction recovered from the naphtha separation step and comprising material boiling above 350° F and up to about 650° F combined with 650° F plus material separated as above described. A portion of the second bottoms fraction separated from 350° F minus naphtha material is collected for use as, for example, a diesel fuel.

The separated 650° F plus bottoms fraction mixed with the second bottoms fraction boiling up to about 650° F and as low as about 350° F generally has a pour point higher than the specification for No. 2 (distillate) fuel oil and diesel oil. A kerosene component fraction thereof has too high a freeze point for use as a jet fuel. Therefore, the mixed fractions boiling above 350° F provided as above described is then passed in contact with a catalyst comprising a special crystalline zeolite having a silica to alumina ratio of at least 12, a constraint index of 1 to 12 and preferably a crystal density of not substantially below about 1.6 grams per cubic centimeter at a temperature of about 500° to 800° F, a space velocity of about 0.5 to 5 LHSV and preferably under hydrogen pressure of about 100 to 800 psig. When the preferred hydrogen pressure operation is used, the zeolite catalyst preferably has incorporated therewith a suitable Group VIII metal hydrogenation/dehydrogenation component, most preferably nickel, in a proportion of about 0.5 to 5 weight percent.

It is not unusual to carry out the conversion and upgrading operation herein described with a fixed catalyst bed that is periodically taken out of service and regenerated. It is possible, however, to utilize a dense fluidized catalyst bed system or even a dispersed fluidized or transport (FCC type) catalyst system providing facilities for effecting continuous or semicontinous regeneration of catalyst, or regeneration of at least a portion of the catalyst is provided. The product of this upgrading operation is composed of light hydrocarbon gases, principally $C_3$'s, a relatively high quality naphtha boiling range fraction and an upgraded distillate fraction which is usually the largest portion of the product. The distillate fraction thus obtained is a particularly desired product and the catalytic operating conditions are chosen so as to particularly maximize this product while still meeting desired product specifications, such as pour point etc.

According to the instant invention, the product of the zeolite catalyzed upgrading step is distilled or separated to recover a naphtha fraction having an end point in the range of 350° to 400° F as overhead from a higher boiling distillate product fraction as bottoms boiling above about 350° F. The higher boiling distillate product fraction is then separated to recover a selected low freeze point kerosene like fraction boiling up to about 550° F as overhead from a higher boiling low pour point diesel oil as bottoms boiling above about 450° F and more usually comprising 550° F and higher boiling material. The gasoline boiling range fractions obtained as herein described are combined and used as such or blended with other available gasoline components into a gasoline pool. The diesel oil boiling range materials produced in the process combination above discussed may also be combined as desired. Of course, the amount produced will vary with the cut point selected in the process above 350° F.

The following specific example is illustrative of the process combination of the invention as shown by the drawing without intending to be limiting on the scope thereof. That is the cut points between various fraction may be considerably altered depending upon which fraction it is desired to maximize. Gasoline product may be maximized by increasing the product end point from 350° F to 400° F. Jet fuel product may be restricted to boil within the range of 400° to 450° F or increased by boiling within the range of 350° to 550° F. Higher boiling fuel oil yields may similarly be altered by changing the initial boiling point.

A synthetic, highly olefinic full range hydrocarbon charge, produced as by Fischer-Tropsch synthesis from a gaseous mixture comprising carbon monoxide and hydrogen is condensed in a series of coolers to produce about 20,000 parts per day of light oil and decant oil which are both fed to a distillation system not shown. This distillation usually produces a light oil fraction having an end boiling point selected within the range of 350° to 400° F destined for use in a gasoline pool. One or more middle fractions such as a 350° F–650° F higher boiling distillate fraction and a 650° F–850° F heavy distillate fractiion may also be separated. The remainder, 850° F plus material constitutes about 2% of the feed, and is destined for use as a residual or bunker fuel, or as coking feed.

In the process combination of this invention, a product fraction boiling in the range of 350° to 850° F is recovered and charged to the process of this invention by conduit 10. This product fraction comprises highly olefinic aliphatic compounds of carbon and hydrogen and constituting about 30% of the charge is fed to a catalytic hydrogenation operation in hydropretreater 12 along with hydrogen introduced by conduit 14. The hydrotreater 12 is charged with a hydrotreating catalyst 16 such as cobalt-molybdenum on alumina maintained as a fixed bed of catalyst and at a temperature in the range of about 550°–750° F; a pressure of about 300–1000 psig and a space velocity of about 1–10 LHSV.

The hydrogenated product withdrawn by conduit 18 from zone 12 which now is substantially reduced or eliminated in olefin content and in oxygen content, and has had its lower boiling range materials slightly enriched because of the hydrotreating operation, is then separated in zone 20 to provide a 650° F minus fraction withdrawn overhead by conduit 22 and a 650° F plus fraction withdrawn as a bottoms stream by conduit 24. The overhead 650° F minus product stream in conduit 22 is then further separated in separation zone 26 as by distillation to recover in a specific embodiment of 350° F minus naphtha fraction by conduit 28. As mentioned above, the naphtha end point may be up to about 400° F. A distillate fuel oil fraction is withdrawn by conduit 30 and comprising material boiling above naphtha boiling material such as a (350° F plus) bottom stream. This 350° F plus or higher boiling bottom stream in conduit 30 is conveniently split, with about one half thereof recovered as diesel oil product by conduit 32 and the remaining 350° F plus or 400° F plus portion in conduit 34 is admixed with the 650° F plus bottom fraction in conduit 24 to form a broad boiling range mixture boiling in the range of about 350° or 400° F up to about 850° F. This broad boiling range mixture is passed to catalytic upgrading zone 38 by conduit 36. The catalyst 40 maintained in zonc 38 is in a specific embodiment NiZSM-5 compounded with an alumina binder and disposed in zone 38 as a fixed catalyst bed 40. Hydrogen is introduced by conduit 42 to zone 38 and catalytic upgrading of the broad boiling range mixture is accomplished at a temperature in the range of 550°–800° F, a pressure in the range of 100–800 psig and a space velocity in the range of 0.5–5 LHSV. An upgraded wide boiling range product in conduit 44 is separated in zone 46 as by distillation to recover light gases removed by conduit 48, a liquid naphtha fraction with an end point within the range of 350° to 400° F removed by conduit 50 and a higher boiling bottoms fraction in conduit 52 which amounts to about 50–90% of the feed to the zeolite catalyst upgrading step. The higher boiling bottoms fraction is withdrawn by conduit 52 and further subjected to fractionation or separation in zone 54 under such conditions to recover as overhead by conduit 56 a high quality jet fuel initially boiling within the range of about 350° to 400° F and an end point of about 450° up to about 550° F with a freeze point below about −58° F. A diesel oil withdrawn by conduit 58 may have an initial boiling point within the range of 450°–550° F and an end point of about 850° F. In the specific example of the drawing, the jet fuel has an end point of about 550° F and the diesel fuel has an initial boiling point of about 550° F. The hydrocarbon feed charged to the process of this invention preferably has no nitrogen and/or sulfur impurities and is a product of Fischer-Tropsch upgrading of synthesis gas ($H_2$ + CO) which has previously been purified. The process combination described herein differs from the more conventional petroleum combinations of hydrotreating and upgrading with zeolite catalysts because of feed compositions. When upgrading crude oil fractions, it is to be emphasized that because of the nitrogen content of the feed material it is essential that desulfurization be accomplished after a pour point reduction step in order that low molecular weight basic nitrogen compounds, such as ammonia, which would be formed during the desulfurization, will not contact the zeolite catalyst employed. In the process combination of this invention, it it to be noted that the hydrotreating precedes zeolite conversion for the purpose of converting olefins and oxygenates in the synthetic feed. This sequence is essential, because the synthetic feed in the instant process is highly olefinic and is high in oxygenates, particularly organic acids, that would other wise deactivate the zeolite catalyst. These adverse synthetic feed properties are a direct result of the fact that the instant charge stock is derived from a Fischer-Tropsch synthesis process. Having thus generally described the invention and specifically discussed a process arrangement going to the essence thereof, it is to be understood that no undue restrictions are to be imposed by reasons thereof except as defined by the following claims.

What is claimed is:

1. A process for producing a high-quality jet fuel which comprises hydrotreating a wide boiling range hydrocarbon fraction of Fischer-Tropsch synthesis comprising olefins and oxygenates and boiling in the range of about 350° to 850° F;

separating the product of hydrotreating to produce a 650° F minus overhead fraction and a 650° F plus bottoms fraction;

separating the overhead 650 minus fraction to produce a first overhead naphtha fraction comprising 350° F minus material from a 350° F plus bottoms fraction;

admixing at least a portion of said 350° F plus bottom fraction with said 650° F plus bottoms above recovered;

contacting the mixture thus formed with a catalyst comprising a special zeolite having a silica to alumina ratio of at least 12, and a constraint index of 1 to 12 at a temperature in the range of about 500° to 800° F, under hydrogen pressure in the range of about 100 to 800 psig and at a space velocity in the range of about 0.5 to 5 LHSV, to produce a product comprising a $C_5$ to 350 naphtha boiling range hydrocarbon fraction and a higher boiling distillate boiling range fraction; and separating said higher boiling distillate fraction into a jet fuel boiling fraction and a higher boiling diesel fuel fraction.

2. The process claimed in claim 1 wherein said zeolite is ZSM-5.

3. The process of claim 1 wherein said zeolite catalyst is provided with from about 0.5 to about 5 weight percent of a metal hydrogenation/dehydrogenation component.

4. The process of claim 1 wherein said first overhead naphtha fraction is combined with said naphtha boiling range material recovered from said zeolite catalyst conversion step.

5. The process of claim 1 wherein the high boiling distillate fraction recovered from said zeolite catalyst conversion step is separated to recover a jet fuel of about 550° F end boiling point from a higher boiling diesel fuel.

6. The process of claim 1 wherein the yield of jet fuel product is altered by changing the end boiling point within the range of 450° to 550° F.

7. The process of claim 1 wherein the yield of jet fuel product is altered by changing the initial boiling point of the jet fuel within the range of 350° to 400° F.

8. The process of claim 1 wherein the product of the zeolite conversion step is separated under conditions providing a jet fuel product boiling within the range of 350° up to about 550° F.

9. The process of claim 1 wherein hydrotreating of a wide boiling range of hydrocarbon fractions comprising olefins and oxygenates is accomplished under conditions to saturate olefinic compounds and convert oxygenates.

* * * * *